United States Patent [19]

Trine et al.

[11] Patent Number: 4,803,458

[45] Date of Patent: Feb. 7, 1989

[54] CONTROL SWITCH AND POTENTIOMETER FOR HEARING AIDS AND THE LIKE

[75] Inventors: John A. Trine, Lake Elmo; David A. Samdahl, White Oak; Daryle L. Petersen, Eagan, all of Minn.

[73] Assignee: Wilbrecht Electronics, Inc., St. Paul, Minn.

[21] Appl. No.: 90,687

[22] Filed: Aug. 28, 1987

[51] Int. Cl.[4] ..... H01C 10/50

[52] U.S. Cl. ..... 338/198; 338/172; 338/200

[58] Field of Search ..... 338/172, 200, 198; 381/68.6, 69

[56] References Cited

U.S. PATENT DOCUMENTS 3,840,838 10/1974 Ja et al. ..... 338/200 X

*Primary Examiner*—C. L. Albritton

*Attorney, Agent, or Firm*—Moore & Hansen

[57] ABSTRACT

A control switch and potentiometer assembly for use in an in-the-canal type hearing air comprising a miniature single pole, single or double throw, push-pull control switch and rotary potentiometer. The components of the control switch and potentiometer are mounted within a durable thermoplastic resin housing which is anchored within the hearing aid. A single control knob for actuation of the control switch and potentiometer is raised and shaped to permit gripping between the fingertips of the user for removing the hearing aid from the ear canal.

The switch contacts and switch wiper are designed such that the process of pulling on the potentiometer control knob to remove the hearing aid will extend the control switch, thereby disengaging a normally closed switch contact and opening a battery powered circuit so as to turn the hearing aid off. A contact leg portion of a switch wiper has a projecting corner which slidingly engages a ramp section on one of the switch contacts, thereby providing an adjustable spring force which resists moving the potentiometer control knob between the extended and retracted positions.

24 Claims, 3 Drawing Sheets

CONTROL SWITCH AND POTENTIOMETER FOR HEARING AIDS AND THE LIKE

BACKGROUND OF THE INVENTION

This invention relates generally to miniature switches and potentiometers, and particularly to a combined push-pull switch and rotary potentiometer volume control assembly for use in hearing aids and similar devices.

Hearing aids and their components are well known to the art, with many technological advances having been made in the functional capabilities of such devices, as well as in those aesthetic features which are of critical importance in the particularly competitive marketplace.

In general, hearing aids may be divided into three broad categories: larger amplifiers carried in an individual's pocket or attached to a belt and having a cable-connected earphone; "behind-the-ear" units in which a microphone and amplifier are contained in a curved case held behind the ear with a speaker or earphone positioned in or near the opening of the ear canal; and "in-the-canal" models wherein the entire hearing aid (including the microphone, amplifier, and speaker) are self-contained and inserted within the ear canal.

As the size of the hearing aid decreases, the cost of the electronic components will generally increase and the capabilities of the hearing aid will decrease proportionately. This is not to suggest that smaller in-the-canal type hearing aids cannot be extremely effective nor include many features of larger hearing aids, but simply reflects the fact that the difficulty and expense of designing and manufacturing miniaturized versions of more complex filters or more powerful amplifiers will generally lead to a more expensive overall unit. Consequently, there is a balancing between the miniaturization of the hearing aid, the inclusion of options which would enhance the amplification or quality of sound reproduction, and the cost of the hearing aid. The features and capabilities required in a particular hearing aid also depend upon the needs of the user as dictated by their degree of hearing impairment, the environment in which the hearing aid will be used, and the personal preferences of the purchaser.

Behind-the-ear hearing aids, which are somewhat larger and more visible but can provide a higher measure of amplification and sound quality at a lower price, are more popular in European countries where socialized medicine largely controls health care expenditures. In the United States and other countries, however, where consumers determine what features and styles they prefer and can afford and where cosmetic considerations are taken into greater account, in-the-canal hearing aids are more popular and widely used.

It is therefore of critical importance, particularly with in-the-canal type hearing aids, to utilize the available space as efficiently as possible, and to make each component of the unit function optimally.

Improvements are continually being made, not only in the fundamental electronic components of hearing aids such as microphones, amplifiers, or speakers, but also in peripheral components such as the battery or battery case, sound conducting channel, switches, controls, as well as other aesthetic and cosmetic factors.

One particular area of development has been in the switches used to turn the hearing aids on or off, and those controls responsible for varying the gain or volume level and other acoustical characteristics of the amplification circuits.

A noteworthy improvement along this line has been the incorporation of a rotary potentiometer and common switch into an integral assembly, such that one component can be used for both power control and gain adjustment. Representative examples of such assemblies may be seen in U.S. Pat. Nos. 3,629,780; 4,081,782; and 4,117,444. A similar and related improvement disclosed in U.S. Pat. No. 4,649,366 was the inclusion of a trimmer control within the potentiometer knob.

Although each of these examples presents a general advance in the art, each of the disclosed structures possess some common drawbacks and disadvantages.

The switches or potentiometer knobs for volume control are generally mounted close to flush with the surface of the hearing aid, and are therefore equipped with radially projecting fins or serrated teeth to facilitate rotation of the knobs. Despite such measures, these controls remain difficult to adjust accurately since they are too small or too close to the surface of the hearing aid to be pinched between the fingers, a method allowing for finer adjustment.

Further, the mechanical components of such switch and potentiometer assemblies are so complex and fragile that the potentiometer knobs have a tendency to break or be accidentally pulled off the hearing aid during normal use. While such a problem might be expected more with the raised potentiometer knobs of the type shown in the '780 patent listed above, in which the knob is held in place by a thin stop plate and sealed above a slightly flared segment of the driver, it is encountered with almost all potentiometer and switch assemblies including those which are nearly flush mounted. One proposed solution to this problem is disclosed in U.S. Pat. No. 3,549,828 showing a retaining ring which securely mounts the switch and potentiometer assembly in the hearing aid housing.

While many of the rotary potentiometers and switch assemblies disclosed are rotated to turn the switch on or off, an alternative has been to place the on-off switch in combination with the battery compartment. One method has been to insert the battery into a hinged clip which can pivot in and out of a recessed well within the hearing aid. In this case, the cover of the battery compartment forms a handle which may be gripped by a person's fingers, and the process of pivoting the battery clip from the compartment breaks the electrical contact to the battery and turns off the power. Variations on this idea are shown in U.S. Pat. Nos. 3,475,566 and 4,634,815 which disclose an integral toggle switch within the battery compartment of a behind-the-ear hearing aid, and a rotatable push-button switch and potentiometer assembly housed within the battery compartment cover, respectively.

The '815 patent states that such a control provides a single but relatively large operating element, a factor which may make such a control undesirable for many applications. Furthermore, the particular design of the '815 switch and potentiometer mitigates against the use of serrations or gripping aids, and prevents a user from pinching the potentiometer knob between his fingers to make finer adjustments. The alternative, as in the case of the '566 patent, is to have separate controls on the face plate, which is less efficient.

Another area of development has been the structural features used to insert and remove the hearing aid from the ear canal. As hearing aids are made progressively smaller and less obtrusive, they are similarly designed to be inserted further into the ear canal, and form a more secure engagement therewith, to enhance their acoustic transmission. Consequently, it is necessary to provide some means for the user to easily remove the hearing aid from the ear canal for washing, sleeping, adjustments, and servicing.

One example of such a device is shown in U.S. Pat. No. 4,565,904 which discloses a pivotally hinged removal handle mounted in the face plate of a hearing aid adjacent the battery compartment cover. This handle may be made of a transparent plastic resin so as to be less visible, and may be pivoted outwardly to an extended position with a fingernail, and then gripped between the user's fingertips.

To be functional, however, such a removal handle must be much larger than shown in the drawings of the '904 patent, and the hinge assembly and metal pin necessary to secure the handle in place consumes a major portion of the surface of the face plate, further congesting the control panel and limiting the space available for other components. Despite the size of the removal handle, it remains subject to being broken or snapped off at its thinner regions due to the twisting or prying force applied by the user when removing the hearing aid.

BRIEF SUMMARY OF THE INVENTION

It is therefore one object of this invention to provide an on-off control switch and volume control potentiometer assembly for use with an in-the-canal type hearing aid which may additionally be used for the insertion and removal of the hearing aid from the ear canal.

It is a related object of this invention to design the above control switch and potentiometer assembly such that the control switch has a reciprocal push-pull motion for making and breaking the switch contacts, and rotational motion for the potentiometer control knob, with the reciprocal motion being aligned generally parallel with the axis of rotation of the potentiometer control knob.

It is a further object of this invention to design a control switch and potentiometer assembly so as to withstand the forces applied to such an assembly during normal use as a control switch and potentiometer, and to withstand the additional forces exerted when using the control switch and potentiometer assembly to facilitate insertion and removal of the hearing aid.

It is another object of this invention to design the above control switch and potentiometer assembly such that the control switch may have dual on-off or recharging positions, and such that the potentiometer circuit is continuously engaged.

It is an additional object of this invention to design the above control switch and potentiometer such that the control switch is automatically moved to either the off or recharging position upon removal of the hearing aid.

It is a related object of this invention to design the above control switch and potentiometer such that upon removal, the potentiometer knob is moved to an extended position further displaced from the surface of the hearing aid, thereby permitting the user a better opportunity to firmly grip the potentiometer control knob for removal.

Briefly described, the control switch and potentiometer assembly of this invention comprises a miniature single pole, single or double throw, push-pull control switch and rotary potentiometer. The components of the control switch and potentiometer are mounted within a durable thermoplastic resin housing which is anchored within the hearing aid. The potentiometer control knob is raised and shaped to permit gripping between the fingertips of the user for removing the hearing aid from the ear canal.

The switch contacts and potentiometer rotary contact wiper are designed such that the process of pulling on the potentiometer control knob to remove the hearing aid will extend the control switch, thereby disengaging a normally closed switch contact and engaging a normally open switch contact. The skirt portion of the switch wiper has a rounded corner which slidingly engages a ramp section on one of the switch contacts, thereby providing an adjustable spring force which resists moving the potentiometer control knob between the extended and retracted positions. An extended shoulder on the driver shaft of the potentiometer prevents the control knob from being accidentally broken off or removed.

DESCRIPTION OF THE PREFERRED EMBODIMENTS

The push-pull control switch and rotary potentiometer assembly of this invention is shown in FIGS. 1–8 and referenced generally therein by the numeral 10.

Figure 1:
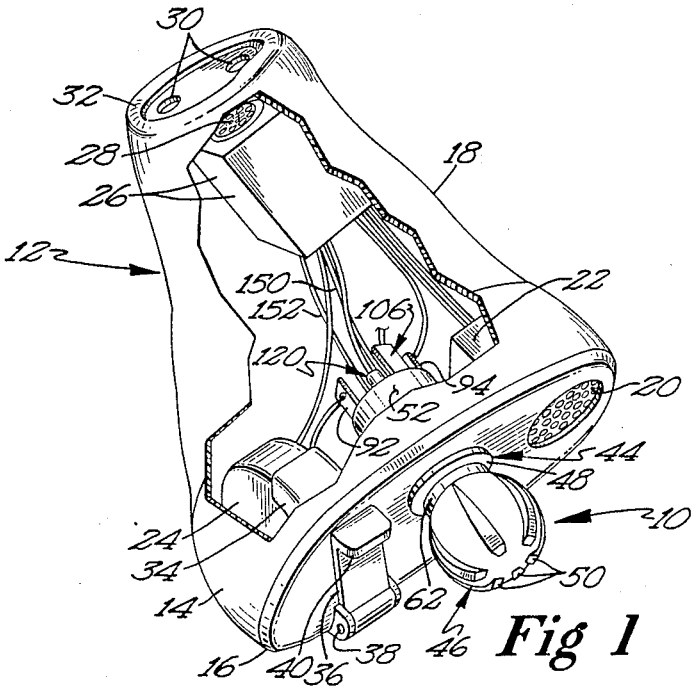
FIG. 1 is a perspective view of a hearing aid showing the control switch and potentiometer of this invention.

Referring to FIG. 1, the components of a conventional in-the-canal hearing aid 12 may be seen. Such a hearing aid 12 comprises a main body 14, a face plate or contact plate 16 on the exterior surface thereof, and pliable channel member 18. Extending through the face plate 16 is an aperture 20 positioned adjacent a highly sensitive microphone 22. The microphone 22 is connected to a power supply 24 such as a battery, an amplifier 26, and a speaker 28. The speaker 28 is positioned adjaent to a second aperture 30 located in the proximal end 32 of the channel member 18. The battery 24 may be contained within a compartment having a hinged cover generally parallel with the face plate 16, or the battery 24 may be retained in a movable battery clip 34 having a pivoting cover member 36 which is connected to the face plate 16 at one end by a hinge 38 and has a handle member 40 at the opposing end as shown in FIG. 1.

Figure 3:
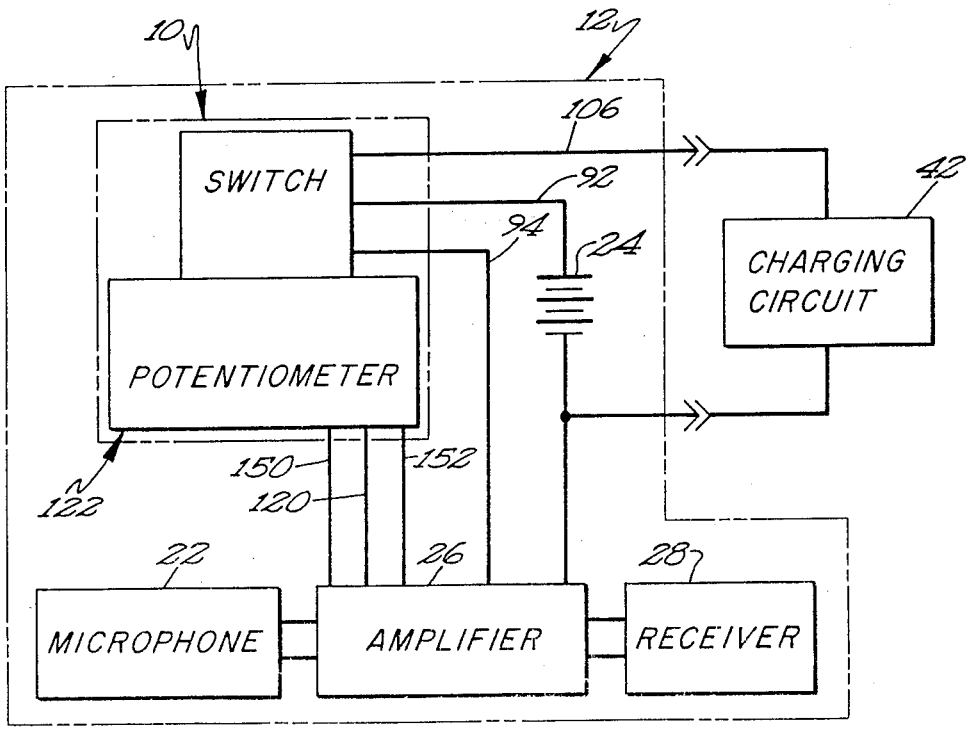
FIG. 3 is a schematic diagram of a hearing aid circuit including the control switch and potentiometer of this invention.

Referring to FIG. 3, a general schematic diagram of the electronic circuit used in such a hearing aid is shown, including the control switch and potentiometer assembly 10. The circuit comprises a contact switch (SWITCH) either of a single pole single throw (SPST) or single pole double throw (SPDT) variety, and a potentiometer (POT) capable of producing an incrementally or continuously variable resistance within the circuit. A SPST switch has proven suitable for most situations, although a SPDT switch is preferable when the main circuit includes an optional circuit 42 for recharging the battery 24, telephone use, or other such applications.

Figure 2:
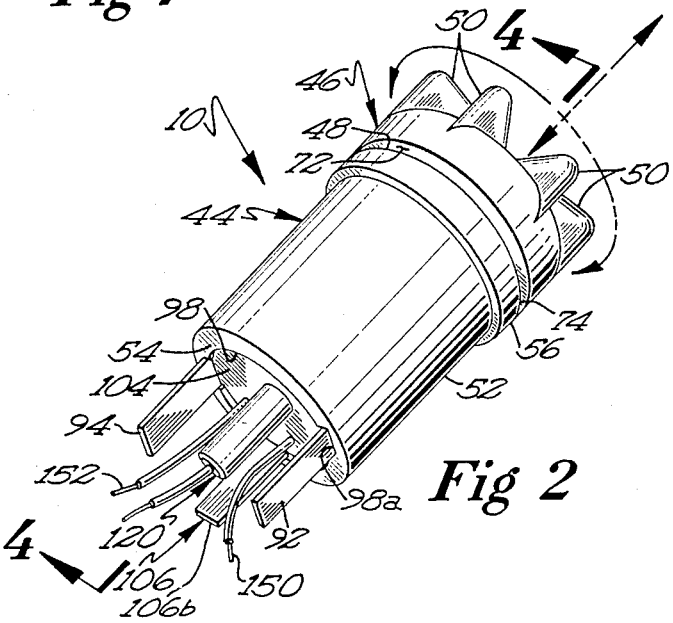
FIG. 2 is a perspective view of the control switch and potentiometer of this invention with a different control knob configuration.

Referring to FIG. 2, it may be seen that the control switch and potentiometer assembly 10 has an outer body portion or housing 44, and a knob member 46 extending from the proximal end 48 of that body portion 44. The knob member 46 may be of any shape suitable for gripping between the fingertips of the user of the hearing aid 12, such as the generally spherical shape shown in FIG. 1 or the disk-like shape of FIG. 2, and may include a plurality of raised fin members 50 which enhance the user's ability to rotate the knob member 46 when the hearing aid 12 is inserted in the ear canal.

Figure 4A:
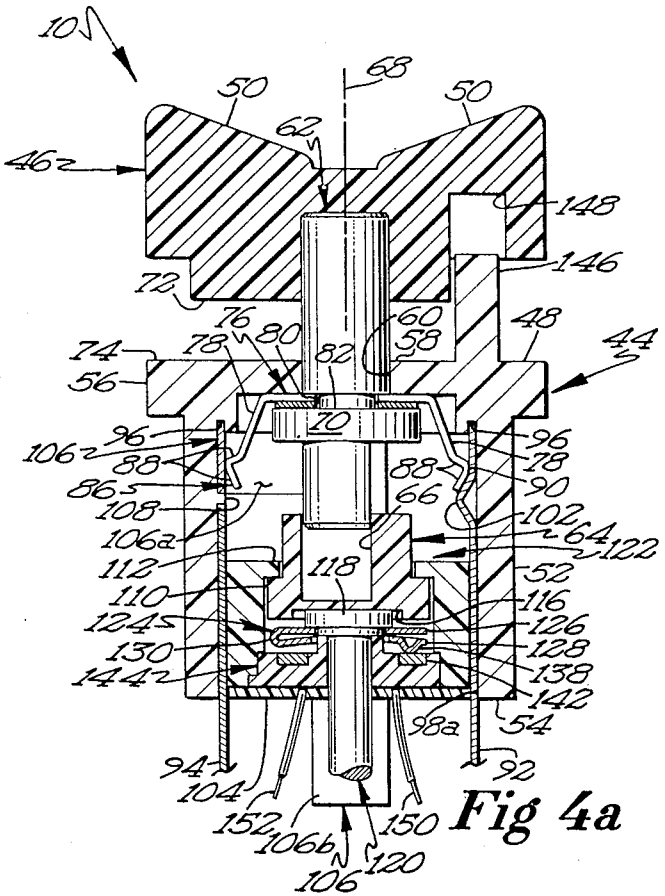
FIG. 4*a* is a cross-section view of the control switch and potentiometer in the extended position taken through line 4—4 in FIG. 2.
Figure 4:
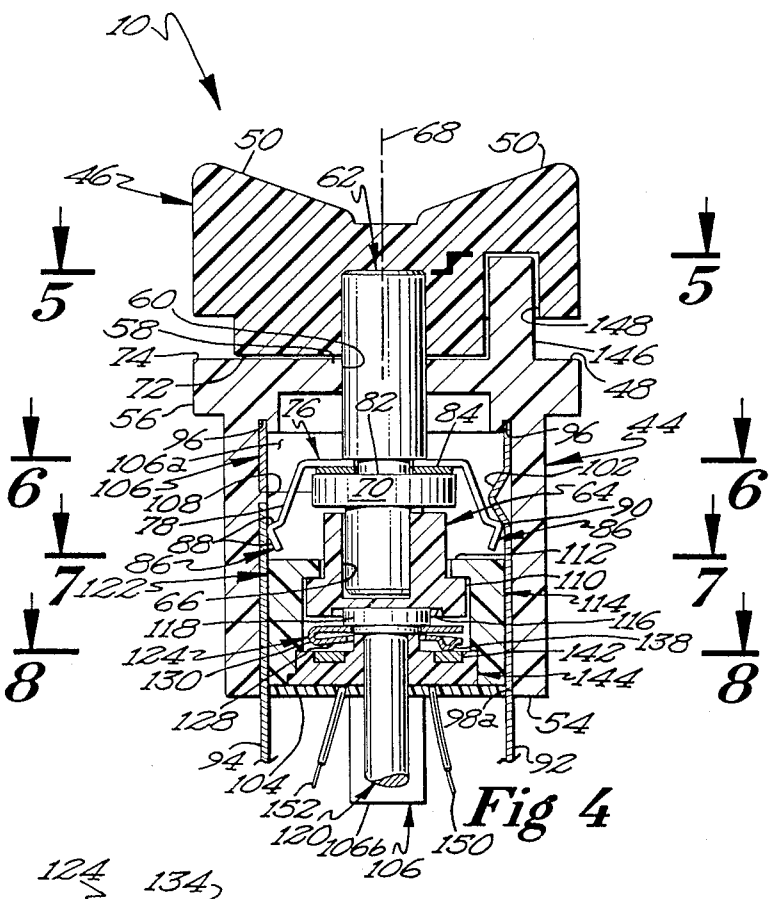
FIG. 4 is a cross-sectional view of the control switch and potentiometer in the retracted position taken through line 4—4 in FIG. 2.

Referring to FIGS. 4 and 4*a*, the internal construction of the control switch and potentiometer assembly 10 may be seen. The body portion or housing 44 of the control switch and potentiometer assembly 10 consists of a hollow cylindrical outer wall 52 having an open distal end 54, and a projecting radial shoulder 56 located adjacent to the proximal end 48 of the housing 44. The proximal end 48 of the housing 44 is substantially enclosed by a retaining collar portion 58 which extends radially inward from the outer wall 52 and defines a centrally positioned driver aperture 60 which receives and slidingly carries a driver shaft 62.

Figure 5:
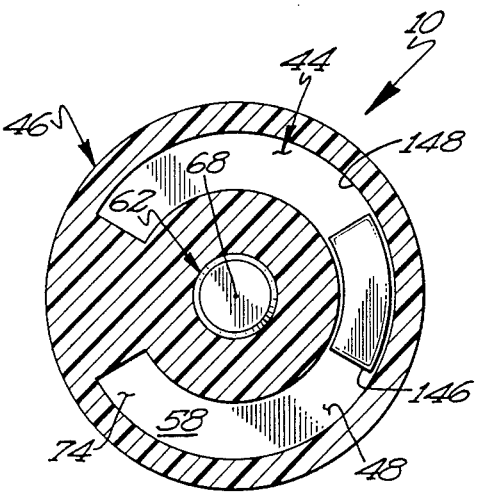
FIG. 5 is a transverse cross-sectional view of the control switch and potentiometer taken through line 5—5 in FIG. 4.
Figure 6:
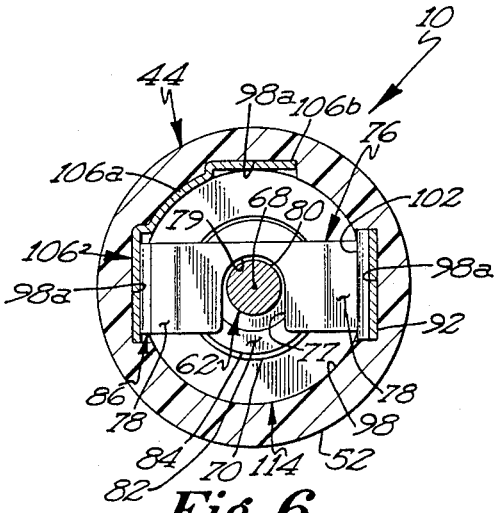
FIG. 6 is a transverse cross-sectional view of the control switch and potentiometer taken through line 6—6 in FIG. 4.
Figure 7:
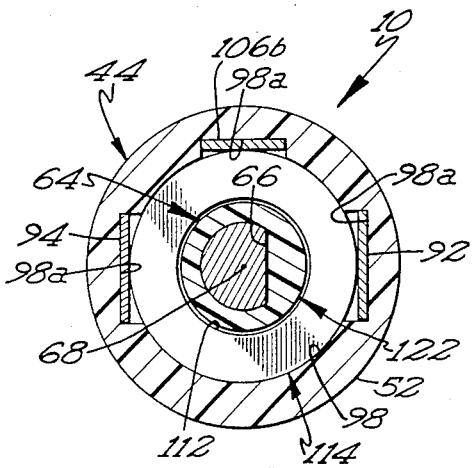
FIG. 7 is a transverse cross-sectional view of the control switch and potentiometer taken through line 7—7 in FIG. 4.

The top region of the driver shaft 62 has a circular cross section as shown in FIG. 5, while the lower region of the driver shaft 62 has a generally D-shaped or flat sided circular cross section which is slidingly received and engaged in a rotor member 64 which similarly defines a corresponding D-shaped bore 66, as shown in FIG. 6. The opposing end of the driver shaft 62 is engagingly received within and staked to, or is molded integrally with, the knob member 46. The lower D-shaped or flat sided portion of the driver shaft 62 is radially offset from the center line or axis of rotation 68 of the top region of the driver shaft 62. Extending radially outward from the surface of the driver shaft 62 above and closely adjacent to the D-shaped lower region thereof is a driver shaft shoulder 70 having an outer radial diameter substantially greater than the inner diameter of the retaining collar portion 58 of the housing 44 defining the driver aperture 60. Thus, the shoulder 70 of the driver shaft 62 may not pass through the driver aperture when the knob 46 is pulled out to the extended position shown in FIG. 4*a*.

In this manner, the driver shaft 62 may be slidingly carried through a range of reciprocal motion between a first or retracted position wherein the lower portion of the driver shaft 62 is entirely received within the bore 66 of the rotor member 64 and the bottom surface 72 of the knob member 46 contacts or closely confronts the top surface 74 of the retaining collar portion 58 as shown in FIG. 4*a*, and a second or extended position whereat the lower portion of the driver shaft 62 is substantially removed but not entirely disengaged from the bore 66 of the rotor member and the driver shaft shoulder 70 is proximate to, and the bottom surface 72 of the knob member 46 is displaced significantly from, the top surface 74 of the retaining collar portion 58 as shown in FIG. 4*a*.

Similarly, the driver shaft 62 may be rotated in either a clockwise or counter-clockwise direction by applying a corresponding torque to the knob member 46, which will in turn cause the rotor member 64 to rotate in the same direction through an equivalent angle.

Connected to and carried on the driver shaft 62 is a switch wiper 76. As is best shown in FIGS. 4*a* and 6, the switch wiper 76 is in the form of an elongated metal strip bent downwardly at its opposite ends to provide two depending contact legs 78. A slot 77 in the horizontal central portion 81 of switch wiper 76 is curved at its inner end 79. The switch wiper 76 is received within a notch 80 in the driver shaft 62 and is spaced a distance above the top surface 82 of the driver shaft shoulder 70 by a spacing washer 84. Slot 77 fits around the reduced diameter center segment of shaft 62 within notch 80. The distal end region 86 of the depending contact legs 78 of the switch wiper 76 has a convoluted or corrugated fold as shown in FIG. 4, with two generally angled segments 88 intersecting at a rounded outer corner 90.

The rounded outer corner 90 of the depending contact legs 78 of the switch wiper 76 extends radially outward and is urged into electrically conductive contact with a pair of switch contacts 92, 94. Switch contact 92 is generally referred to as a common switch contact 92, while switch contact 94 is termed a normally closed switch contact 94.

Common switch contact 92 extends upwardly along the length of the inner surface 98 of the outer wall 52 and is received within a notch 96 adjacent the radial shoulder 56 and a recessed portion 98*a* of the outer wall 52. The upper region of the common switch contact 92 defines an inwardly projecting ramp section 102 having a pair of angled members intersecting at a rounded corner similar to but opposing the distal region 86 of the contact legs 78. The lower ends of the common and normally closed switch contacts 92, 94 extend downwardly out through the open distal end 54 of the housing 44.

The lower end of each contact 92, 94 is held in place by a retaining layer 104 formed from a plastic epoxy resin or similar suitable material. Aligned with and spaced a distance above the normally closed switch contact 94 is a normally open switch contact 106, the upper end of the normally open switch contact 106 being received within a notch 96 adjacent the radial shoulder 56, with the normally closed switch contact 94 and the normally open switch contact 106 presenting a nonconductive gap 108 therebetween which may be filled with the material used to form the outer wall 52 to prevent electrical shorts or sparking.

The normally open switch contact 106 has a generally L-shaped configuration comprised of an upper, curved segment 106*a* which extends laterally along the inner surface 98 of the outer wall 52 in generally conforming relation therewith to a position generally between the common and normally closed switch contacts 92, 94, and a longitudinally downwardly extending segment 106*b* which extends out through the bottom retaining layer 104 and the open distal end 54 of the housing 44 as shown in FIG. 4.

When the driver shaft 62 is in the retracted or inwardly pushed position as shown in FIG. 4, an electrical circuit is completed from the common switch contact 92 through the switch wiper 76 and the normally closed switch contact 94. When upward pulling pressure is exerted on the knob 46 such that the drive shaft 62 moves to the extended position as shown in FIG. 4*a*, the common switch contact 92 is connected through the switch wiper 76 to the normally open switch contact 94. Thus, as may be noted with respect to FIG. 3, with the switch in this open or off position, the power circuit to the hearing aid electrical components will be interrupted.

In moving the knob 46, driver shaft 62, and switch wiper 76 to the extended position as shown in FIG. 4*a*, the rounded outer corner 90 of the contact legs 78 must ride over the facing and opposing inwardly projecting ramp section 102 of the common switch contact 92. This provides a restraining force which resists moving the knob 46, driver shaft 62, and switch wiper 76 between the retracted position of FIG. 4 and the extended position of FIG. 4*a*. It is thus possible to adjust or regulate the force necessary to move the knob 46, driver shaft 62, and switch wiper 76 between the retracted and extended positions by altering the composition, thickness, or flexibility of the metal used in the switch wiper 76, or by modifying the radial displacements of the rounded outer corner 90 of the contact legs 78 and the inwardly projecting ramp section 102 of the common switch contact 92.

Figure 10:
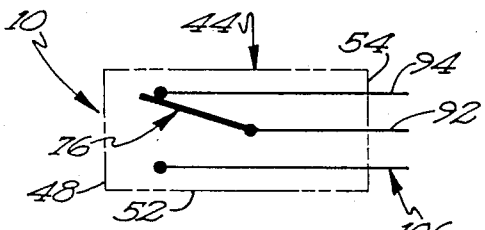
FIG. 10 is a circuit diagram of the control switch shown in FIGS. 4–7.

The common, normally open, and normally closed switch contacts 92, 94, 106 may thereby be used to form the SPDT switch configuration described above in reference to FIGS. 4 and 4*a*. A diagram of such a switch arrangement is shown in FIG. 10. With a charging circuit utilized as shown in FIG. 3, the normally open contact 106 would be connected to that circuit as shown. If no charging circuit is required, an SPST switch could be used, and contact element 106 would be eliminated.

Referring again to FIG. 4, it may be seen that the lower portion of the rotor member 64 defines an outwardly projecting radial shoulder region 110 which engages under a corresponding inwardly projecting radial ledge 112 of an element housing member 114. Housing member 114 extends downwardly and into adhering contact with the retaining layer 104 and outwardly toward the outer wall 52 to contact and further hold the common and normally closed switch contacts 92, 94 in place, as well as to keep the rotor element 64 aligned along the axis of rotation 68.

The lower surface of the rotor member 64 adjacent the outwardly projecting radial shoulder region 110 defines a recessed region 116 which receives the top end 118 of a common terminal 120 of the potentiometer assembly 122. The common terminal 120 is in the form of a generally cylindrical shaft portion which extends downwardly out through the retaining layer 104 and open distal end 54 of the housing 44.

Figure 8:
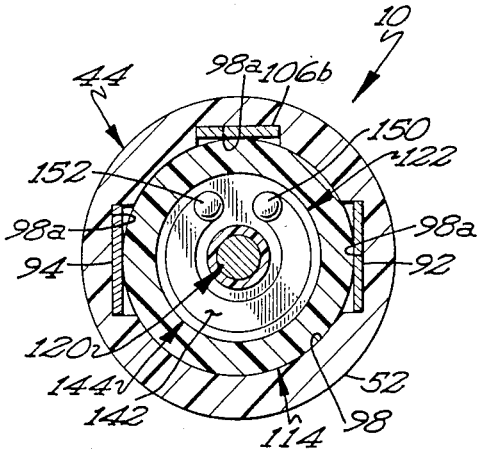
FIG. 8 is a transverse cross-sectional view of the control switch and potentiometer taken along line 8—8 of FIG. 4.
Figure 9:
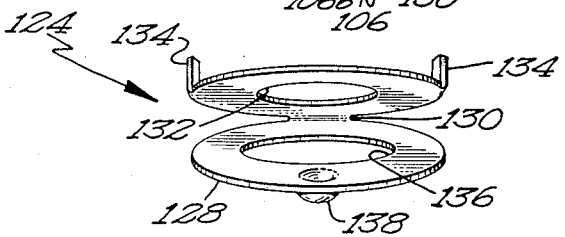
FIG. 9 is a perspective view of the potentiometer wiper element of this invention.

A potentiometer wiper element 124 constructed from a thin layer of metallic foil is rotatingly received on the shaft portion of the common terminal 120 of the potentiometer assembly 122. The potentiometer wiper element 124 is shown in FIG. 9, and comprises an upper and lower disk member 126, 128, respectively, connected at their peripheral edges along a thin bridge segment 130. The upper disk member 126 defines a smaller central aperture 132 and a pair of tab members 134 extending outwardly and upwardly from opposing sides thereto. The lower disk member 128 defines a larger central aperture 136 and a semicircular wiper contact projection 138 depending downwardly adjacent the outer peripheral edge 140 of the lower disk member 128. The upper and lower disk members 126, 128 are folded together across the bridge member 130, and the tab members 134 are folded generally perpendicular to the surface of the upper disk member 126, such that the tab members extend upwardly and the semi-circular wiper contact projection 138 extends downwardly from opposing sides of the folded disk members 126, 128 as shown in FIG. 8.

The disk members 126, 128 are then slidingly received and positioned on the potentiometer assembly 122 with the common terminal 120 extending through the apertures 132, 136 of the disk members 126, 128, and the tab members 134 being engagingly received and affixed within the outwardly projecting radial shoulder region 110 of the rotor member 64 such that the wiper element 124 rotates in both the clockwise and counterclockwise directions with the knob member 46, driver shaft 62, and rotor member 64.

The semi-circular wiper contact projection 138 extends and is urged downwardly into contact with a resistive element 142 which is embedded in a base member 144 adjacent the retaining layer 104. As is shown in FIG. 8, the resistive element 142 defines an arcuate path concentrically encircling the common terminal 120 of the potentiometer assembly 122, the arcuate path corresponding to the range of rotational motion of the knob 46, driver shaft 62, rotor 64, and semi-circular wiper contact projection 138 of the wiper element 124. The degree of rotation of these components is constrained to less than one full revolution by a block 146 which projects upwardly from the proximal end 48 of the housing 44 and is received within an arcuate recessed track 148 defined by the lower portion of the knob 46.

Each end of the arcuate resistive element 142 is electrically connected to a wire lead 150, 152, each of which extends downwardly through the base member 144 and retaining layer 104. In this manner, the potentiometer assembly 122 as described above may form a pair of alternate closed electrical circuits of inversely variable resistance extending from the common terminal 120 through the wiper element 124, resistive element 142, and either wire lead 150 or 152.

While any variety of electrically conductive materials may be used in constructing the control switch and potentiometer assembly 10 of this invention, it has proven satisfactory to fashion the switch wiper 76 from a beryllium-copper metal, while the switch contacts 92, 94, 106, common terminal 120, and wiper element 124 may be made from gold-plated brass. The driver shaft should be constructed from stainless steel or a plated brass which is corrosion resistant. The body portion 44 and knob member 46 may be constructed of any resilient moldable thermoplastic such as glass filled nylon or an acetal resin, which have also proven suitable for constructing the rotor member 64, element housing member 114, and base member 144.

In operation, the proximal end 32 of the hearing aid 12 is inserted into the ear of the user, such that the speaker 28 is directed into the ear canal and at the user's eardrum. The hearing aid 12 is entirely received within the user's ear or ear canal, and the microphone 22 is positioned so as to receive ambient noise reaching the user's ear.

The outer wall 52 of the housing 4 of the switch and potentiometer assembly 10 is firmly mounted using thermal welding, adhesive bonding, or other suitable mechanical means within the main body 14 of the hearing aid 12, and extends through the face plate 16. The common and normally closed switch contacts 92, 94 are connected by soldering or other electrical means to a first electronic circuit, such as a power control circuit including the battery 24 as shown in FIG. 1. The common terminal 120 and one or both leads 150, 152 of the potentiometer assembly 122 are similarly connected by soldering or other electrical means to a second electronic circuit requiring variable resistance such as a volume or gain control. The common and normally open switch contacts 92, 106 may optionally be connected by soldering or other electrical means to a third electronic circuit, such as a recharging circuit for recharging the battery 24.

The volume of the sound amplified by the amplifier 26 and emitted by the speaker 28 may be controlled by rotating the knob member 46 in either a clockwise or counter-clockwise direction, depending upon the manner in which the common terminal 120 and leads 150, 152 have been connected to the hearing aid amplification and control circuit.

When the user inserts the hearing aid 12 into his ear canal, he places pressure upon the knob member 46, thereby urging the knob member 46, drive shaft 62, and switch wiper 76 to the retracted position as shown in FIG. 4, with the rounded corner 90 of the contact legs 78 of the switch wiper 76 engaging under the ramp section 102 of the common switch contact 92, whereby a first electrical circuit is completed through the normally closed switch contact 94 to supply power from the battery 24 to the hearing aid amplification and control circuit.

When the user removes the hearing air 12 from his ear canal, he grips or pinches the knob member 46 between his fingertips, and exerts a pulling force thereon to remove the hearing aid 12. In so doing, the pulling force on the knob member 46 will cause the knob member 46, driver shaft 62, and switch wiper 76 to move to the extended position as shown in FIG. 4, with the rounded corner 90 of the contact legs 78 of the switch wiper 76 riding over the ramp section 102 of the common switch contact 92, thereby breaking or interrupting the first electrical circuit previously completed through the normally closed switch contact 94, and engaging or completing an optional electrical charging circuit through the normally open switch contact 106.

It is also contemplated that because certain configurations of the knob member 46 and various spring tensions between the contact legs 78 and common switch contact 92 may be more desirable for different individuals, a method of field testing and selecting the desired design configurations must be formulated. To accomplish this result, it has proven suitable to construct a box or frame member (not shown) having a series of apertures into which several of the control switch and potentiometer assemblies 10 are installed, each control switch and potentiometer assembly 10 having a differently shaped knob member 46 or spring tension, thus permitting a user to directly compare and select the particular shape for the knob member 46 and spring tension which is desired.

While the preferred embodiments of the disclosed invention have been described with reference to the accompanying drawing figures, it is understood that modifications and improvements in the design and construction of the control switch and potentiometer assembly 10 of this invention may be made without departing from the spirit and scope of the appended claims.

What is claimed is:

1. A switch and potentiometer assembly for use in electrical connection with a hearing aid having a microphone, an amplifier, and a speaker to be inserted within an ear canal of a user, said switch and potentiometer assembly comprising:

a housing;

a driver shaft extending within said housing and mounted for rotational motion around an axis of rotation and reciprocal motion generally parallel with said axis of rotation;

a knob member connected to and carried on said driver shaft, said knob member being positioned such that said knob member may be gripped by the user while inserting or removing the hearing aid from the ear canal, said knob member and said driver shaft further being movable between a retracted position proximate to said housing and an extended position displaced outwardly from said housing and from said retracted position;

normally closed switch means movable between a closed position completing a first electrical circuit and an open position interrupting said first electrical circuit, said switch means being movable from said closed position to said open position responsive to said driver shaft being moved from said retracted position to said extended position; and variable resistance means for varying a resistance of a second electrical circuit, said variable resistance means varying said resistance of said second electrical circuit in response to rotation of said driver shaft around said axis of rotation, whereby the hearing aid may be moved against a resistive force by the user pulling on or pushing against the knob member such that the first electrical circuit is disconnected and the hearing aid is turned off when the hearing aid is moved against the resistive force by the user pulling on the knob member and moving the driver shaft to the retracted position, and the first electronic circuit is completed and the hearing aid turned on when the hearing aid is moved against the resistive force by the user pushing on the knob member and moving the driver shaft to the retracted position.

2. The switch and potentiometer assembly of claim 1 further comprising:

normally open switch means movable between an open position interrupting a third electrical circuit and a closed position completing said third electrical circuit, said normally open switch means being movable from said open position to said closed position responsive to said driver shaft being moved from said retracted position to said extended position.

3. The switch and potentiometer assembly of claim 2 wherein the normally closed switch means and the normally open switch means have a common terminal with which a conductive switch wiper of said switch means is in contact as said driver shaft is moved between the retracted position and the extended position.

4. The switch and potentiometer assembly of claim 1 wherein the resistance varying means further comprises:

a rotor member mounted within said housing for rotational motion relative to the housing and responsive to rotation of the driver shaft, said rotor member defining a bore, said bore slidably receiving at least a portion of the driver shaft therein;

a resistive element; and a wiper element connected to said rotor member and having at least one portion which contacts said resistive element.

5. The switch and potentiometer assembly of claim 4 wherein the bore of the rotor member has a cross section defining at least one flat side, and the portion of the driver shaft received within the bore has a cross section defining at least one flat side, such that the driver shaft is engagingly received within the bore with said flat side of the driver shaft adjacent said flat side of the bore for driving connection between said driver shaft and said rotor.

6. The switch and potentiometer assembly of claim 4 wherein the wiper element comprises:

a first disk defining a first aperture and having a peripheral edge, said first disk further having one or more tab portions extending upwardly therefrom and engaging the rotor member; and a second disk connected to said first disk along said peripheral edge thereof and further defining a second aperture, said second disk having a depending projection defining said one portion which contacts the resistive element, said first and second disks being mounted for rotation relative to the resistive element and responsive to the rotation of the rotor member.

7. The switch and potentiometer assembly of claim 6 further comprising:

a common potentiometer terminal, said common potentiometer terminal being connected to and in electrical contact with the wiper element, at least a portion of said common potentiometer terminal extending through the housing.

8. The switch and potentiometer assembly of claim 7 wherein the first and second disks are slidably mounted on the common potentiometer terminal such that the common potentiometer terminal extends through the first and second apertures in the first and second disks, at least a portion of the first disk continuously contacting the common potentiometer terminal as the first and second disks rotate responsive to the rotation of the rotor member.

9. The switch and potentiometer assembly of claim 4 wherein the resistive element forms an arcuate path positioned generally concentrically to the axis of rotation of the driver shaft.

10. The switch and potentiometer assembly of claim 4 further comprising:

a common potentiometer terminal; and a base member wherein the resistive element is engagingly mounted in said base member, said base member defining an aperture extending therethrough, and further wherein said common potentiometer terminal extends through said aperture.

11. The switch and potentiometer assembly of claim wherein the housing defines a driver shaft aperture having a diameter, and wherein the driver shaft extends through said driver shaft aperture.

12. The switch and potentiometer assembly of claim 11 wherein the driver shaft includes a shoulder portion contained within said housing inside of said driver shaft aperture, said shoulder portion having a cross sectional diameter greater than the diameter of the driver shaft aperture, such that said shoulder portion of the driver shaft may not pass through the driver shaft aperture when said knob is pulled to the extended position.

13. The switch and potentiometer assembly of claim 1 wherein the knob member defines a recessed track region having two opposing ends, and wherein the housing defines a block projecting from the housing and slidably received within the recessed track region of the knob member, whereby said block alternately contacts the opposing ends of said recessed track region as the knob member is rotated to thereby define a degree of rotation less than one full revolution through which the knob member may rotate.

14. The switch and potentiometer assembly of claim 1 wherein the normally closed switch means comprises:

a common switch contact;

normally closed switch contact; and a switch wiper connected to and carried on the driver shaft and contacting both said common switch contact and said normally closed switch contact when the driver shaft is in the retracted position.

15. The switch and potentiometer assembly of claim 14 wherein the normally closed and common switch contacts extend through the housing.

16. The switch and potentiometer assembly of claim 1 wherein the normally closed switch means comprises:

a common switch contact;

a normally open switch contact; and a switch wiper connected to and carried on the driver shaft and contacting both said common switch contact and said normally open switch contact when the driver shaft is in the extended position.

17. The switch and potentiometer assembly of claim 16 wherein the normally open and common switch contacts extend through the housing.

18. The switch and potentiometer assembly of claim 16 wherein the normally open switch contact has a generally L-shape.

19. The switch and potentiometer assembly of claim 14 wherein the switch wiper has a depending contact leg defining a corner region extending radially outward and confronting the common switch contact, and wherein the common switch contact defines a ramp region projecting generally inward and confronting said corner region of the switch wiper and a pair of opposing sides adjacent said ramp region, whereby the corner region of the wiper is positioned on one of the sides of the ramp region of the common switch contact when the driver shaft is in the retracted position, and the corner region of the wiper is positioned on the opposing one of the sides of the ramp region of the common switch contact when the driver shaft is in the extended position, the corner region of the wiper springingly contacting and sliding over the ramp region of the common switch contact when the driver shaft is moved between the retracted and extended positions.

20. The switch and potentiometer assembly of claim 1 wherein the normally closed switch means and first electrical circuit are electrically connected to a power supply for the hearing aid.

21. The switch and potentiometer assembly of claim 2 wherein the normally open switch means and third electrical circuit are electrically connected to a recharging circuit.

22. In an in-the-canal type hearing aid having a housing with an exterior surface and further comprising a microphone, an amplifier, and a speaker, wherein the hearing aid is inserted into an ear canal of a user, the improvement comprising:

a switch and potentiometer assembly having a knob member extending from the hearing aid and positioned as to be gripped by the user for inserting and removing the hearing aid from the ear canal of the user, said knob member being carried on the hearing aid so as to be reciprocally movable between a retracted position proximate to the exterior surface of the hearing aid and an extended position displaced from said retracted position, said knob member further being rotatable around an axis of rotation, said switch and potentiometer assembly further having switch means for completing at least a first electrical circuit responsive to said knob member being moved to said retracted position and for interrupting said first electrical circuit responsive to said knob member being moved to said extended position, and said switch and potentiometer assembly further having a variable resistance means for varying the resistance of a second electrical circuit responsive to the knob member being rotated about said axis of rotation.

23. A switch and potentiometer assembly for use with a hearing aid to be inserted within an ear canal of a user, said switch and potentiometer assembly comprising:

a housing;

a driver shaft extending within said housing and having a portion projecting externally thereof, said driver shaft being mounted for reciprocal motion and rotational motion;

a knob member connected to and carried on said driver shaft externally of said housing, said knob member and said driver shaft further being movable between a retracted position wherein said knob is proximate to said housing and an extended position displaced from said retracted position;

switch means movable between a closed position completing a first electrical circuit and an open position interrupting said first electrical circuit, said switch means being movable between said closed position and said open position in response to said driver shaft being moved between said retracted position and said extended position; and variable resistance means for varying a resistance of a second electrical circuit, said variable resistance means varying said resistance of said second electrical circuit responsive to rotation of said driver shaft.

24. An in-the-canal type hearing aid assembly to be inserted within an ear canal of a user, said hearing aid assembly comprising:

a housing having a face plate region;

a microphone;

an amplified electrically connected to said microphone;

a speaker electrically connected to said amplifier;

a driver shaft assembled within said housing with a portion of said driver shaft projecting outside of the housing, said driver shaft being mounted for reciprocal motion and rotational motion;

a knob member connected to and carried on said driver shaft outside of said housing, said knob member and said driver shaft further being movable between a retracted position wherein said knob member is proximate to said face plate region of said housing and an extended position wherein said knob is displaced from said face plate region;

switch means movable between a closed position completing a first electrical circuit and an open position interrupting said first electrical circuit, said switch means being movable between said closed position and said open position in response to said driver shaft being moved between said retracted position and said extended position by said knob; and variable resistance means for varying the resistance of a second electrical circuit, said variable resistance means varying said resistance of said second electrical circuit responsive to rotation of said driver shaft.

* * * * *